US005631688A

United States Patent [19]

Hibino et al.

[11] Patent Number: 5,631,688

[45] Date of Patent: May 20, 1997

[54] THERMAL TRANSFER PRINTER

[75] Inventors: Ikuo Hibino; Hirotoshi Terao; Shinichi Sagawai; Hiroshi Kobayashi, all of Iwate-ken, Japan

[73] Assignee: Alps Electric Co., Ltd., Tokyo, Japan

[21] Appl. No.: 631,764

[22] Filed: Apr. 10, 1996

[30] Foreign Application Priority Data

Apr. 10, 1995 [JP] Japan ..... 7-083795
Nov. 13, 1995 [JP] Japan ..... 7-294303

[51] Int. Cl.[6] ..... B41J 2/325

[52] U.S. Cl. ..... 347/171; 347/198; 347/188; 347/193

[58] Field of Search ..... 347/171, 188, 347/198, 193; 400/120.01, 120.09, 120.13, 120.17

[56] References Cited

FOREIGN PATENT DOCUMENTS 2-208058 8/1990 Japan ..... 347/198

*Primary Examiner*—Huan H. Tran

*Attorney, Agent, or Firm*—Guy W. Shoup; Patrick T. Bever

[57] ABSTRACT

Disclosed is a thermal transfer printer which makes it possible to perform both recording using an ink ribbon coated with a hot melt ink and recording using an ink ribbon coated with a hot sublimation ink. In the thermal transfer printer, a thermal head mounted on a carriage is driven to thereby effect printing on printing paper while moving the carriage with the thermal head being held in press contact with a platen through the intermediation of an ink ribbon and printing paper, wherein the thermal transfer printer further comprises a control section which makes it possible to selectively switch, in accordance with a mode signal, between a first recording mode in which printing by hot melt transfer is effected on the printing paper by using a hot melt type ink ribbon as the ink ribbon and a second recording mode in which printing by hot sublimation transfer is effected on the printing paper by using a hot sublimation type ink ribbon as the ink ribbon.

8 Claims, 7 Drawing Sheets

THERMAL TRANSFER PRINTER

BACKGROUND OF THE INVENTION

1. Field of the Invention

The present invention relates to a thermal transfer printer and, in particular, to a thermal transfer printer which is capable of printing on a variety of types of printing paper and which can perform a printing with high image quality comparable to that of silver salt photographs by using a specific kind of printing paper.

2. Description of the Related Art

Thermal transfer printers are generally used as the output apparatus for computers, word processors or the like due to their high quality in printing, their low noise and low cost, ease of maintenance, etc. In a thermal transfer printer, printing paper and an ink ribbon coated with a desired kind of ink are supported in front of a platen, and the ink ribbon is delivered as a thermal head with a plurality of heat generating elements arranged thereon is reciprocated along the platen together with a carriage, with the heat generating elements arranged on the thermal head being selectively caused to generate heat on the basis of printing information to thereby print a desired image in the form of a character, etc. on the printing paper.

Two types are known of the conventional thermal transfer printer: one which prints on printing paper by using an ink ribbon consisting of a plastic base film coated with a hot melt ink (a hot melt ink ribbon) and one which prints on printing paper by using an ink ribbon consisting of a base film coated with a hot sublimation ink (a hot sublimation ink ribbon).

Of these two types, the type of thermal transfer printer which prints on printing paper by using a hot melt ink ribbon (hereinafter referred to as a "hot melt type thermal transfer printer") is useful in that it allows printing on a variety of kinds of paper, such as ordinary paper, cardboard and postcards.

The other type, which prints on printing paper by using a hot sublimation ink ribbon (hereinafter referred to as a hot sublimation type thermal transfer printer") provides a high quality printed image comparable to silver salt photographs by using a specific kind of surface-treated paper.

The hot melt type thermal transfer printer and the hot sublimation type thermal transfer printer have been individually put into practical use as different types of thermal transfer printers due to the differences in the properties of the inks used in them.

As stated above, the hot melt type thermal transfer printer and the hot sublimation type thermal transfer printer have been individually put into practical use, so that when both the general type of printing on ordinary paper and the high-quality printing to produce an image comparable to silver salt photographs are needed, it is necessary to use two different types of thermal transfer printers, i.e., a hot melt type thermal transfer printer and a hot sublimation type thermal transfer printer, which would involve a large space for installation and an increase in cost.

Thus, there is a demand for a thermal transfer printer which is capable of both printing using an ink ribbon coated with a hot melt ink and printing using an ink ribbon coated with a hot sublimation ink.

SUMMARY OF THE INVENTION

The present invention has been made in view of the above problem in the prior art. It is accordingly an object of the present invention to provide a thermal transfer printer which is capable of both printing using an ink ribbon coated with a hot melt ink and printing using an ink ribbon coated with a hot sublimation ink.

Another object of the present invention is to provide a thermal transfer printer of the type in which a thermal head mounted on a carriage is held in contact with a platen through the intermediation of an ink ribbon and printing paper and, in this condition, moved along the platen to thereby effect printing on the printing paper, the thermal transfer printer further comprising a control section which makes it possible to selectively switch between a first recording mode in which printing by hot melt transfer is effected on printing paper by using a hot melt type ink ribbon as the ink ribbon and a second recording mode in which printing by hot sublimation transfer is effected on printing paper by using a hot sublimation type ink ribbon as the ink ribbon in accordance with a mode signal.

Still another object of the present invention is to provide a thermal transfer printer wherein the control section effects control in accordance with the mode signal such that the carriage moving speed in the second recording mode is made lower than the carriage moving speed in the first recording mode and that the heat energy per dot for the thermal head in the second recording mode is made greater than the heat energy per dot for the thermal head in the first recording mode.

A further object of the present invention is to provide a thermal transfer printer wherein the control section effects control in accordance with the mode signal such that it is possible to selectively switch between the force with which the thermal head is held in press contact with the platen in the first recording mode and the force with which the thermal head is held in press contact with the platen in the second recording mode and that the force with which the thermal head is held in press contact with the platen in the second recording mode is made weaker than the force with which the thermal head is held in press contact with the platen in the first recording mode.

A still further object of the present invention is to provide a thermal transfer printer wherein a plurality of ribbon cassettes including a ribbon cassette containing a hot melt ink ribbon and a ribbon cassette containing a hot sublimation ink ribbon are arranged so as to be opposed to the carriage and wherein the control section effects control in accordance with the mode signal such that it is possible to select a desired ribbon cassette from the plurality of ribbon cassettes and attach it to the carriage.

A still further object of the present invention is to provide a thermal transfer printer further comprising separation position control means for selectively varying the separation time needed for separating the ink ribbon from the printing paper after printing in accordance with the mode signal for execution, wherein control is effected such that the separation time in the second recording mode is made longer than the separation time in the first recording mode.

DETAILED DESCRIPTION OF THE PREFERRED EMBODIMENT OF THE INVENTION

Figure 1:
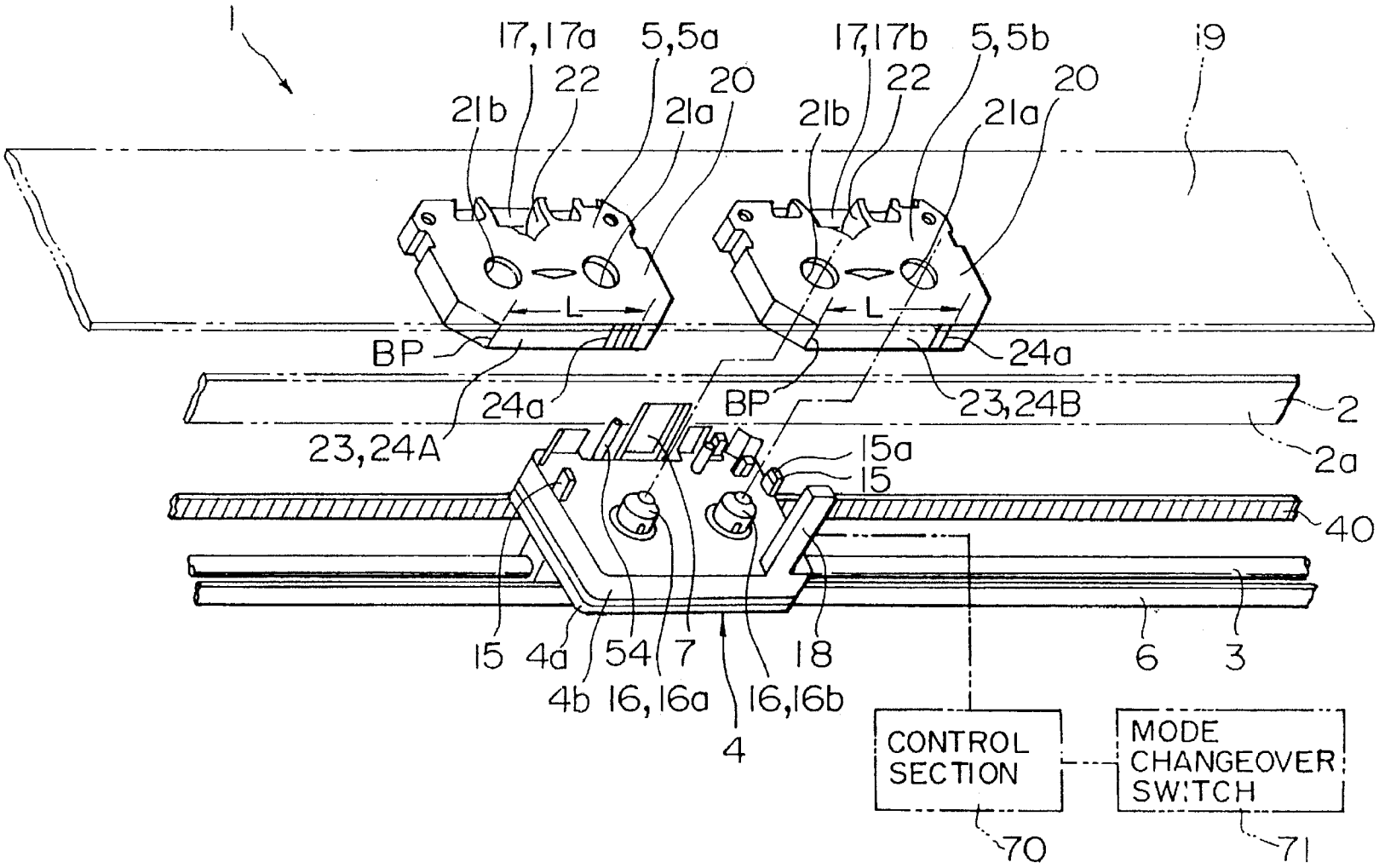
FIG. 1 is a perspective view showing the essential part of a thermal transfer printer according to an embodiment of the present invention.

FIG. 1 shows an embodiment of the present invention. In a thermal transfer printer 1 according to this embodiment, a platen 2 in the form of a plate is arranged at a desired position in a frame (not shown) such that its recording surface 2*a* is substantially vertical, and, in front of and below this platen 2, a guide shaft 3 is arranged so as to be parallel to the platen 2. At an appropriate position on the guide shaft 3, a carriage 4 is mounted, which carriage is divided into upper and lower carriage portions 4*b* and 4*a*. The lower carriage portion 4*a* is mounted on the guide shaft 3. A ribbon cassette 5 described below is attached to the upper carriage portion 4*b*, which can be vertically moved to and away from the lower carriage portion 4*a*. This carriage 4 can be reciprocated on the guide shaft 3 by driving an appropriate driving belt 6, which is looped around a pair of pulleys (not shown), with a driving means such as a stepping motor (not shown). The moving speed of the carriage 4 can be selected between high and low by means of a control section 70 described below.

Arranged on the carriage 4 is a thermal head 7, which is opposed to the platen 2 and can be brought into contact with, and separated from, the platen 2 by a well-known head moving mechanism that can be operated by the driving force of a motor 25 (Neither the head moving mechanism nor the motor 25 is shown in this drawing), the thermal head 7 being held in press contact with the platen 2 (the head-down condition) to record on paper (not shown) on the platen 2. This thermal head 7 is equipped with a plurality of heat generating elements (not shown) which are selectively caused to generate heat on the basis of desired recording information input through an appropriate input device such as a keyboard (not shown). Further, the force with which the thermal head 7 is held in press contact with the platen 2 can be selected between strong and weak by the control section 70 described below, and the heat energy of the thermal head 7 can be selected between large and small (which are, more specifically, stages determined by long and short periods of time for which electricity is supplied to the heat generating elements).

Figure 3:
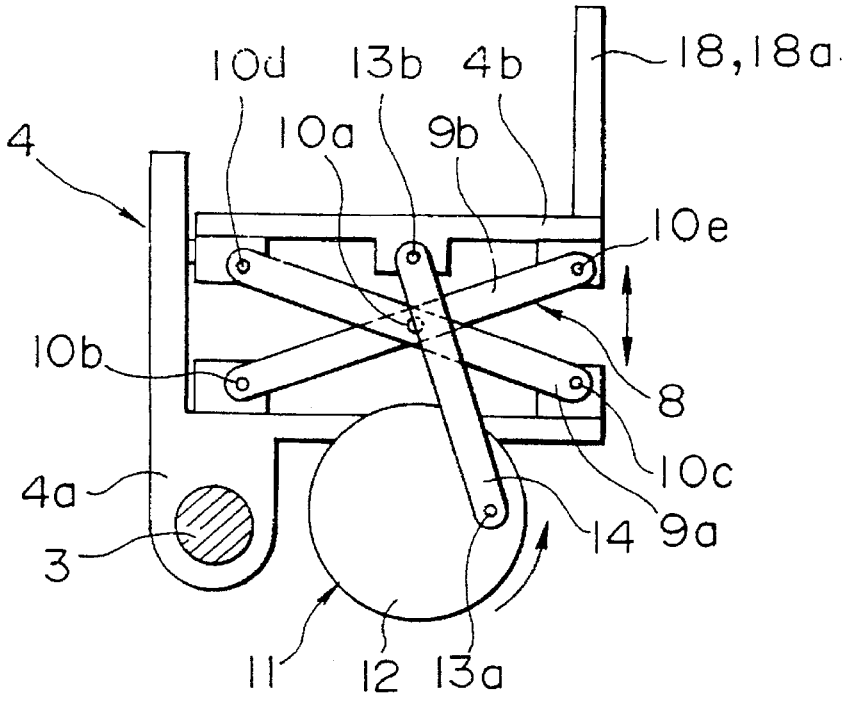
FIG. 3 is a schematic side view of the carriage of the thermal transfer printer of this embodiment.

The carriage 4 will be described in more detail. In the carriage 4, the upper carriage portion 4*b*, which is formed as a flat plate and which is substantially parallel to the upper surface of the lower carriage portion 4*a* attached to the guide shaft 3, is mounted on the upper surface of the lower carriage portion 4*a* so as to be capable of being brought into contact with and separated from the lower carriage portion 4*a* and of moving parallel to the lower carriage portion 4*a* by means of a pair of parallel crank mechanisms 8. As shown in FIG. 3, each of the pair of parallel crank mechanisms 8, which are respectively provided at the right-hand and left-hand ends of the carriage 4, has a pair of links 9*a* and 9*b* crossing each other in an X-like fashion, the intersection of which is made pivotable by a pin 10*a*, with the end portions of the links 9*a* and 9*b* being slidably engaged with elongated holes (not shown) formed at the upper ends of the right-hand and left-hand end portions of the lower and upper carriage portions 4*a* and 4*b* by means of pins 10*b*, 10*c*, 10*d* and 10*e*.

Further, the lower carriage portion 4*a* is equipped with a rotary crank mechanism 11, by means of which the operation of parallel movement of the upper carriage portion 4*b* is effected. This rotary crank mechanism 11 is composed of a rotating plate 12 rotatably supported by the lower carriage portion 4*a* and a connecting link 14 pivoted at an eccentric position of the rotating plate 12 by a pin 13*a* and serving as a connecting member, with the forward end of the connecting link 14 being pivoted to the upper carriage portion 4*b* by a pin 13*b*. The rotating plate 12 is rotated by an appropriate driving means such as a motor (not shown).

Referring back to FIG. 1, plate-like arms 15, whose tips are gently and inwardly curved toward each other and formed as engagement projections 15*a*, protrude from the right-hand and left-hand ends of the upper carriage portion 4*b* so as to be spaced apart from each other by a distance substantially equal to the width of the ribbon cassette 5. In the middle section of the upper carriage portion 4*b*, a pair of rotatable bobbins 16 are arranged so as to protrude upwards and as to be spaced apart from each other by a predetermined distance. By means of these bobbins 16, the ink ribbon 17 can run in a predetermined direction. Of the pair of bobbins 16, one is formed as a take-up bobbin 16*a* for taking up the ink ribbon 17, and the other is formed as a delivering bobbin 16*b* for delivering the ink ribbon 17. Further, on the farther end edge with respect to the platen 2 of the carriage 4, a first optical sensor 18 is arranged, which serves as a sensor for detecting the kind of ink ribbon 17 accommodated in the ribbon cassette 5. In this embodiment, this first optical sensor 18 is of a reflection type. This first optical sensor 18 is connected to the control section 70, which is arranged at a desired position in the thermal transfer printer 1 and serves as the control means for controlling the recording operation, etc. of the thermal transfer printer 1.

Figure 2:
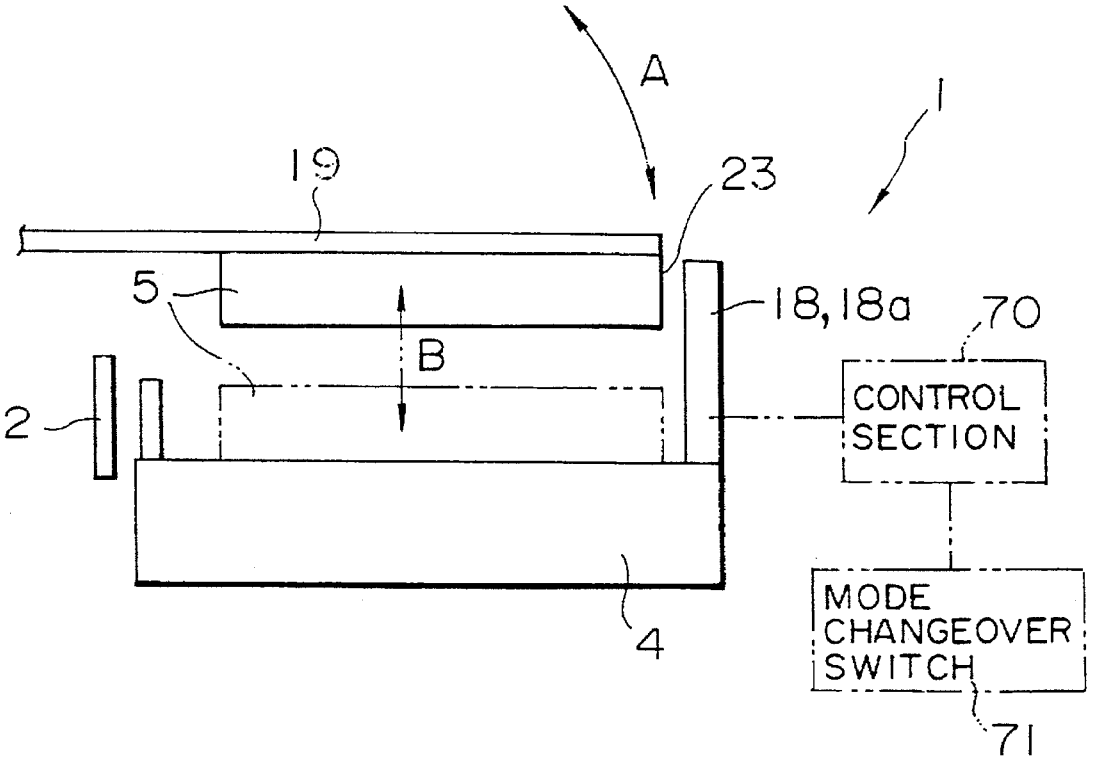
FIG. 2 is a schematic side view of the essential part of the thermal transfer printer of this embodiment.

As shown in FIGS. 1 and 2, a canopy 19 formed substantially as a plate is arranged above the carriage 4 and at a position appropriately spaced apart therefrom and supported by a frame (not shown) so as to be capable of being opened and closed as indicated by the arrows A in FIG. 2. In the closed state, this canopy 19 functions as the paper presser on the outlet side of a paper feeding mechanism (not shown), and is arranged opposite to the carriage 4, extending over a range substantially equal to the range of movement of the carriage 4.

At a predetermined position on the lower side of the canopy 19, extending opposite and parallel to the carriage 4, a plurality of cassette holders (not shown) for holding the ribbon cassette 5 are provided, and, by means of these cassette holders, a plurality of (two, in this embodiment) ribbon cassettes 5*a* and 5*b* are arranged in a line in the direction in which the carriage 4 is moved. In this embodiment, the ribbon cassette 5*a* accommodates an ink ribbon 17*a* consisting of a base film such as a plastic film coated with a hot melt type ink (a hot melt type ink ribbon), and the ribbon cassette 5*b* accommodates an ink ribbon 17*b* consisting of a base film such as a plastic film coated with a hot sublimation type ink (a hot sublimation type ink ribbon). As indicated by the arrows B in FIG. 2, the ribbon cassettes 5*a* and 5*b* are selectively handed over between the canopy 19 and the upper carriage portion 4*b* by the operation of the parallel crank mechanism 8, which operates with the operation of the rotary crank mechanism 11.

In this embodiment, the ribbon cassettes 5*a* and 5*b* are formed in the same configuration and the same size, regardless of the kind of ink ribbon 17. Each ribbon cassette has a substantially rectangular main case body 20, composed of a pair of upper and lower sections, which contains a pair of rotatably supported reels (not shown), a pair of rotatably supported ribbon feeding rollers, a plurality of rotatably supported guide rollers facing the ribbon feeding path, etc. The ink ribbon 17 runs between the pair of reels, with the middle portion of the ribbon path of the ink ribbon 17 being led to the exterior. When the ribbon cassette 5 is mounted on the upper carriage portion 4*b*, one of the pair or reels serves as a take-up reel for taking up the portion of the ink ribbon 17 which has been used for recording, and the other reel serves as a delivery reel for delivering the ink ribbon. In the inner peripheral surface of each reel, a plurality of key grooves are formed in a spline-like manner circumferentially at intervals. The inner peripheral surface of one reel constitutes a take-up hole 21*a* to be engaged with the take-up bobbin 16*a*, and the inner peripheral surface of the other reel constitutes a delivery hole 21*b* to be engaged with the delivery bobbin 16*b*. Further, a recess 22 facing the thermal head 7 is formed on that surface of the ribbon cassette 5 which faces the platen 2 when the ribbon cassette 5 is mounted on the carriage 4. The intermediate portion of the ink ribbon 17 is led out into this recess 22.

Further, an identification mark 23 for identifying the kind of ink ribbon 17 accommodated in the ribbon cassette 5 is arranged on the back surface of the ribbon cassette 5 extending parallel to that face in which the recess 22 is formed. In this embodiment, the identification mark 23 consists of stripe-shaped non-reflecting sections 24*a* whose number varies according to the kind of ink ribbon 17.

This identification mark 23 is detected by the optical sensor 18*a* provided in the carriage 4, and the detection signal is output to the control section 70 of the printer, where the number of non-reflecting sections 24*a* of the identification mark 23 is counted to thereby discriminate the kind of ink ribbon 17 accommodated in the cassette 5.

In the ribbon cassette 5*a* shown on the left-hand side in FIG. 1, a reflective seal 24A having four non-reflecting sections 24*a* is arranged as the identification mark 23, and in the ribbon cassette 5*b* shown on the right-hand side in FIG. 1, a reflective seal 24B having two non-reflecting sections 24*a* is arranged as the identification mark 23. The left-hand end of the back surface, as seen in FIG. 1, of each ribbon cassette 5 constitutes a reference position BP for detecting the identification mark 23. The distance L between the reference position BP and that non-reflecting section 24*a* which is at the right-hand end as seen in FIG. 1 is made the same in every identification mark 23, and a desired number of non-reflecting sections 24*a* for discriminating the kind of ink ribbon 17 are formed within the range of this distance L. The carriage 4 can be set in position with the identification mark 23 used being detected by the optical sensor 18*a*, and the ribbon cassette 5*a* accommodated in the cassette holder can be passed over to the upper carriage portion 4*b*, with the carriage 4 remaining at rest.

As shown in FIGS. 4 through 7, a motor 25 for bringing the thermal head 7 into contact with the platen 2 and separating it therefrom and for effecting ink ribbon take-up control is arranged in the lower carriage portion 4*a* of the carriage 4, which can reciprocate along the platen 2. The motor 25 has an output pinion gear 26, which is in mesh with a transmission gear 27. The transmission gear 27 is in mesh with a gear section 29 formed on the outer peripheral surface of a cam 28. Formed on the upper surface of the cam 28 are a head contact/separation cam groove 30 and a ribbon take-up cam groove 31 which is wider and shallower than the head contact/separation cam groove 30.

Further, a support shaft 32 is formed in that section of the lower carriage portion 4*a* which is in the vicinity of the platen 2. In this embodiment, this support shaft 32 is formed so as to protrude from the upper surface of the upper carriage portion 4*b*, as shown in FIG. 1. A substantially T-shaped head lever 33 is mounted on this support shaft 32 so as to be swingable around the support shaft 32, and a head mounting base 34 facing the platen 2 is fastened by a screw to that section of the head lever 33 which is in the vicinity of the platen 2. The thermal head 7 is attached to that surface of this head mounting base 34 which faces the platen 2, and, in the head mounting base 34, a stopper 35 protrudes at a fixed interval from the back surface of the head mounting base 34.

Further, a substantially L-shaped press contact lever 36 is mounted on the support shaft 32 so as to be swingable around the support shaft 32, and a pin 37 to be engaged with the head contact/separation cam groove 30 of the cam 28 is formed at one end of this head press contact lever 36. The other end of the head press contact lever 36 is arranged between the back surface of the head mounting base 34 of the head lever 33 and the stopper 35, and a spring retaining section 38 protrudes from the other end portion of the head press contact lever 36. Further, a strong press contact spring 39 is provided between the spring retaining section 38 and the head mounting base 34. Due to the biasing force of this strong press contact spring 39, the head press contact lever 36 is kept in contact with the stopper 35 of the head lever 33, and, in this condition, the head press contact lever 36 and the head lever 33 are integrally rotated by the rotation of the cam 28 when the head moves up and down.

Further, in the carriage 4, a driving gear 41 which is in mesh with a rack 40 formed in the printer is arranged so as to be rotatable around a support shaft 42, and, there is provided, between the support shaft 42 and the head lever 33, a weak press contact spring 43 with a weaker resilient force than that of the above-mentioned strong press contact spring 39, so as to provide a biasing force such that the head lever 33 constantly causes the thermal head 7 to be pressed against the platen 2.

Further, a swinging plate 44 is mounted on the support shaft 42 so as to be swingable around the support shaft 42. At one end of this swinging plate 44, there is formed a pin 45 engaged with the ribbon take-up cam groove 31 of the cam 28. Here, the pin 45 of the swinging plate 44 is thicker than the width of the head contact/separation cam groove 30, so that the pin 45 does not fall into the head contact/separation cam groove 30. Further, at the other end of the swinging plate 44, a support shaft 46 protrudes, on which support shaft there is mounted a transmission gear 47 that is in mesh with the driving gear 41.

Figure 4:
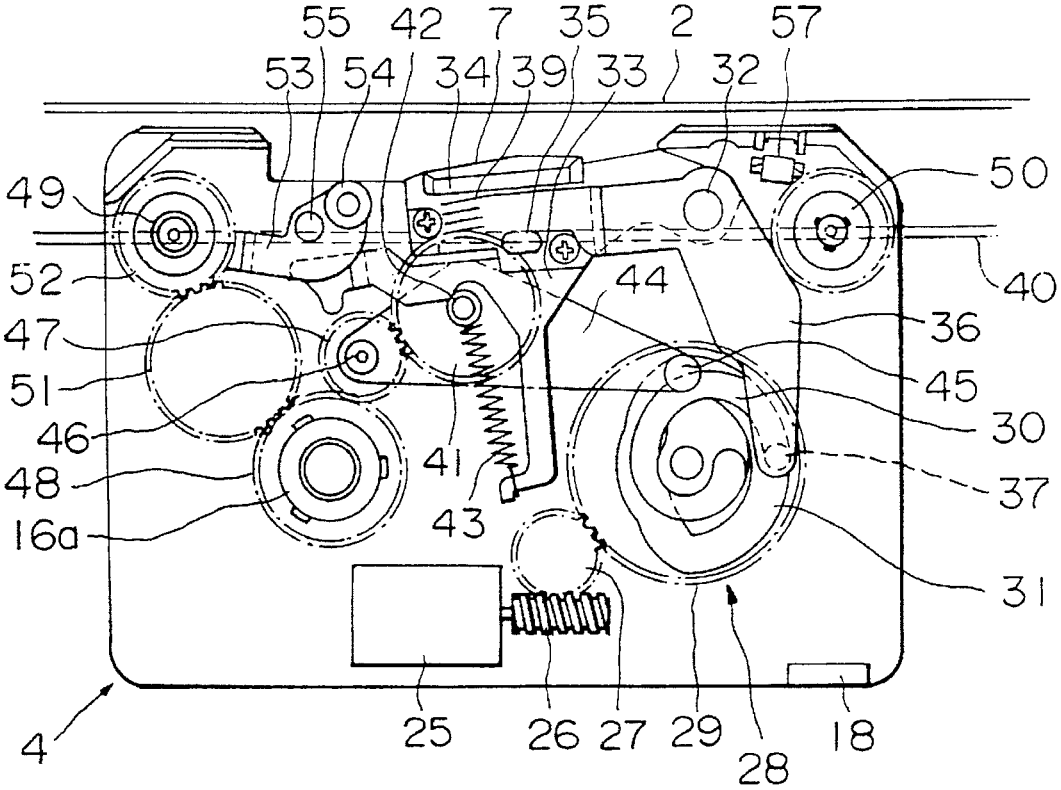
FIG. 4 is a schematic diagram showing the thermal transfer printer of this embodiment in ink ribbon sensing operation.

Further, in the carriage 4, in which, as stated above, the ink ribbon take-up bobbin 16*a* and the delivery bobbin 16*b* are arranged, there is provided, as shown in FIG. 4, a take-up gear 48, which is in mesh with the transmission gear 47, is concentrically mounted on the lower section of the take-up bobbin 16*a* through the intermediation of a friction mechanism (not shown). Further, in this embodiment, there are arranged, in the carriage 4, a second take-up bobbin 49 and a second delivery bobbin 50, and a second take-up gear 52, which is in mesh with the take-up gear 48 of the take-up bobbin 16*a* through the transmission gear 47, is concentrically mounted on the lower section of the second take-up bobbin 49 through the intermediation of a friction mechanism. The take-up bobbin 16*a* and the second take-up bobbin 49 are rotated by the engagement of the transmission gear 47 with the take-up gear 48 due to the swinging of the swinging plate 44, and each of the delivery bobbin 16*b* and the second delivery bobbin 50 can be freely rotated.

Figure 8:
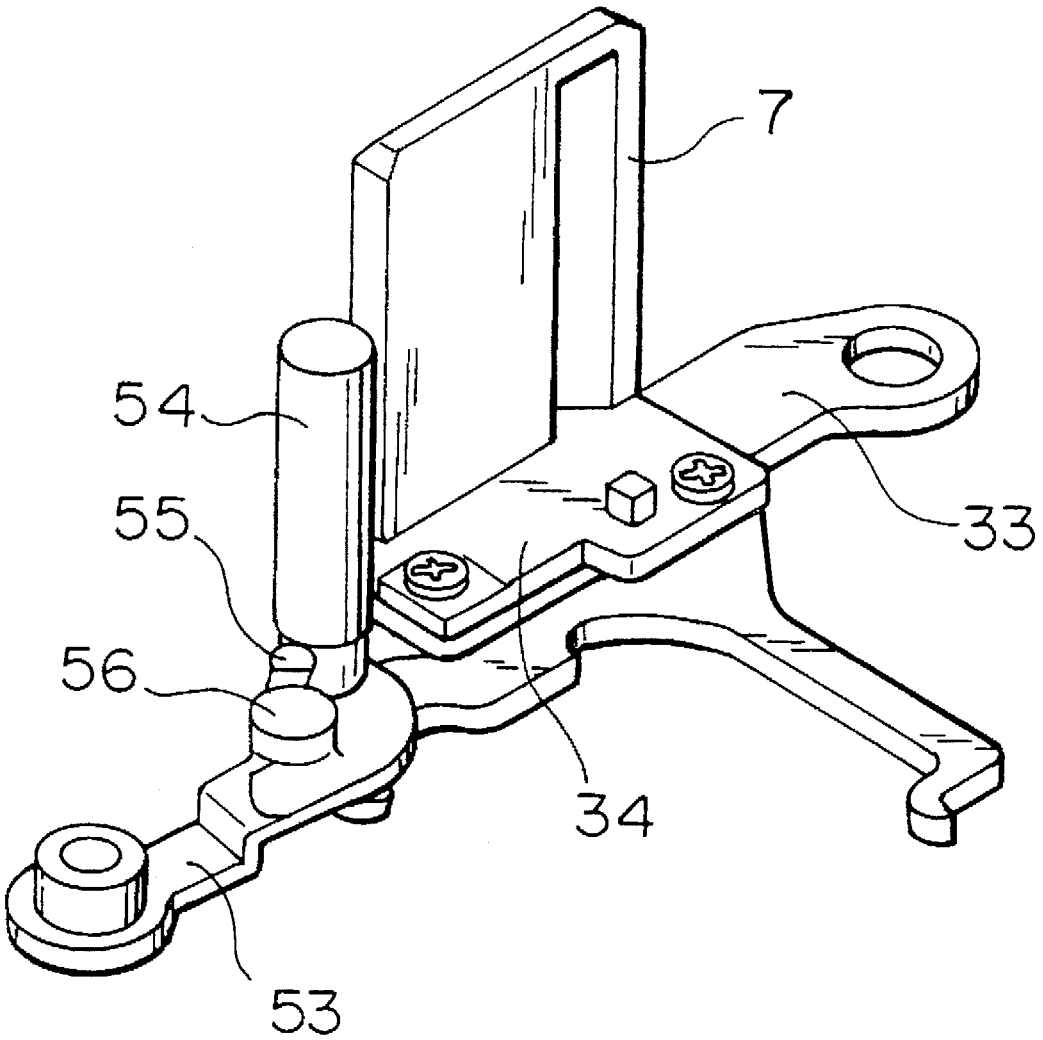
FIG. 8 is a perspective view showing the construction of a separation lever and that of a head lever in the thermal transfer printer of this embodiment.

A separation lever 53 biased so as to be moved away from the platen 2 by a spring (not shown) is rotatably mounted on the rotating shaft of the second take-up bobbin 49, and a separation roller 54 which constitutes a separation guide member, protrudes from the forward end of the separation lever 53 so as to extend upwardly. Further, an engagement pin 55 is mounted in the vicinity of the separation roller 54 of the separation lever 53 so as to be vertically movable, and, as shown in FIG. 8, a spring 56 for upwardly biasing the engagement pin 55 is arranged on the upper side of the separation lever 53 and in the outer periphery of the engagement pin 55. The engagement pin 55 is held by the biasing force of the spring 56 such that its lower end does not protrude below the separation lever 53. By pushing the engagement pin 55 downwards against the biasing force of the spring 56 to cause its lower end to protrude below the separation lever 53, the engagement pin 55 is engaged with the forward end portion of the head lever 33.

Further, on the upper side of the carriage 4, there is arranged a second optical sensor 57 for detecting the rear end of the ink ribbon used.

Referring back to FIG. 1, a cutout 58 into which the separation roller 54 is to be inserted is formed at either symmetrical end of the recess 22 formed on each ribbon cassette 5 and facing the thermal head 7. Further, as shown in FIGS. 9 and 10, in each ribbon cassette 5, there are arranged a pair of hubs 59 which are engaged with the take-up bobbin 16*a* and the delivery bobbin 16*b* and around which the ink ribbon 17 is looped, and, further, a pair of guide rollers 60 which are engaged with the second take-up bobbin 49 and the second delivery bobbin 50 and which guides the ink ribbon 17.

Figure 9:
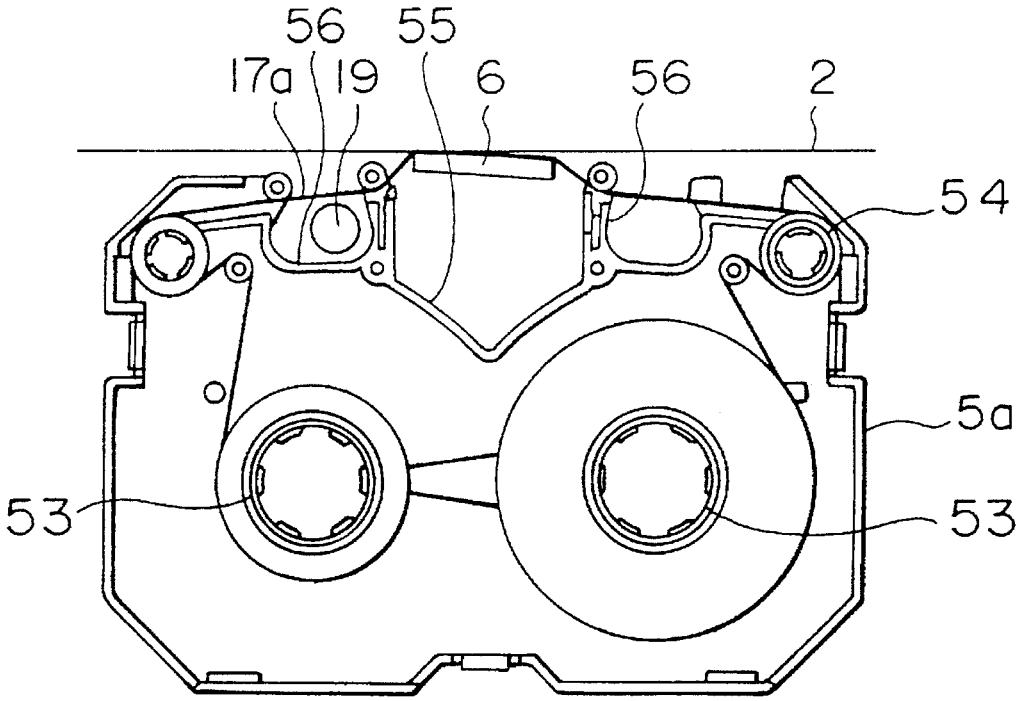
FIG. 9 is a plan sectional view showing a hot melt ink ribbon cassette used in the thermal transfer printer of this embodiment.
Figure 10:
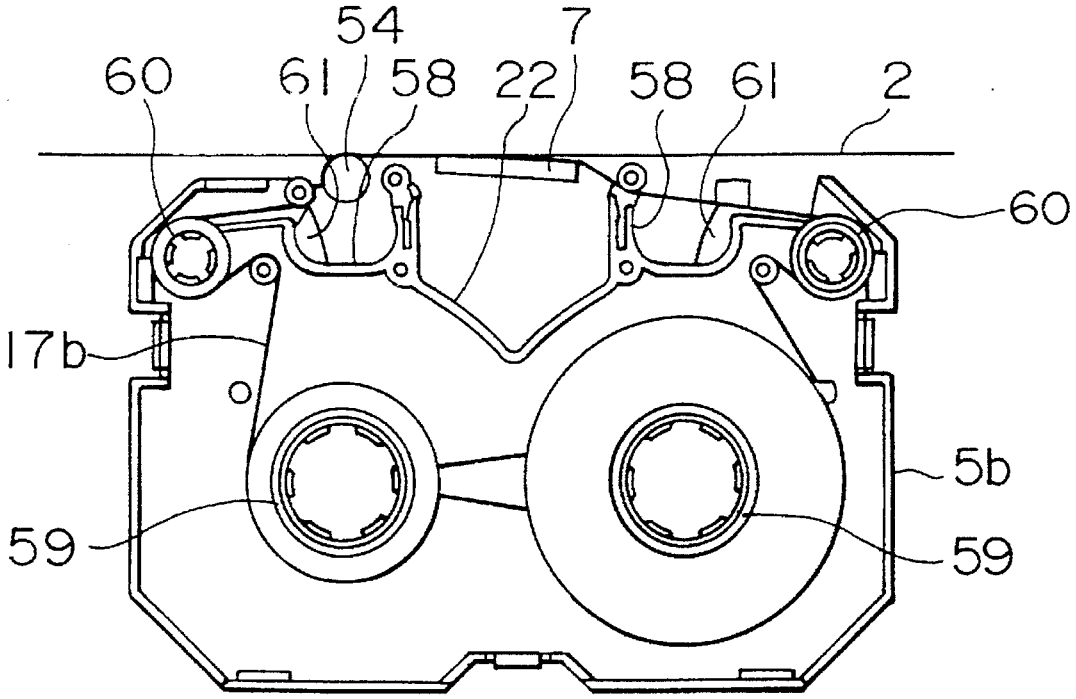
FIG. 10 is a plan sectional view showing a hot sublimation ink ribbon cassette used in the thermal transfer printer of this embodiment.

Further, in the hot melt ink ribbon 17*a* accommodated in the ribbon cassette 5*a*, shown in FIG. 9, a hot separation effect is needed in order that the ink ribbon 17*a* may be separated from the paper at the time of recording while the ink of the ink ribbon 17*a* is in the molten state. In the hot sublimation ink ribbon 17*b* accommodated in the ribbon cassette 5*b*, shown in FIG. 10, a cold separation effect is needed in order that the ink ribbon 17*b* may be separated from the paper at the time of recording after the ink of the ink ribbon 17*b* has been solidified. A pressing/moving plate 61 for downwardly pressurizing the engagement pin 55 of the carriage 4 is formed in each of the cutout 58 of the ribbon cassette 5*b*, in which the ink ribbon 17*b* for cold separation is accommodated. When this ribbon cassette 5*b* for cold separation is attached to the carriage 4, the engagement pin 55 is pressed downwards by the pressing/moving plate 61, and the engagement pin 55 is engaged with the head lever 33. In the cutouts 58 of the ribbon cassette 5*a* accommodating the ink ribbon 17*a* for hot separation, no such pressing/moving plate 61 as that in the ribbon cassette 5*b* for cold separation is formed, so that, when this ribbon cassette 5*a* for hot separation is attached to the carriage 4, the engagement pin 55 is not pressed, and the engagement pin 55 and the head lever 33 are not engaged with each other.

In this embodiment, the ribbon cassette 5 is of multi-time type, which allows use in reverse position, so that two cutouts 58 are formed respectively at symmetrical positions in the recess 22 into which the thermal head 7 is inserted. However, in the case of a so-called one-time type ink ribbon, it suffices to form only one cutout 58.

Figure 11:
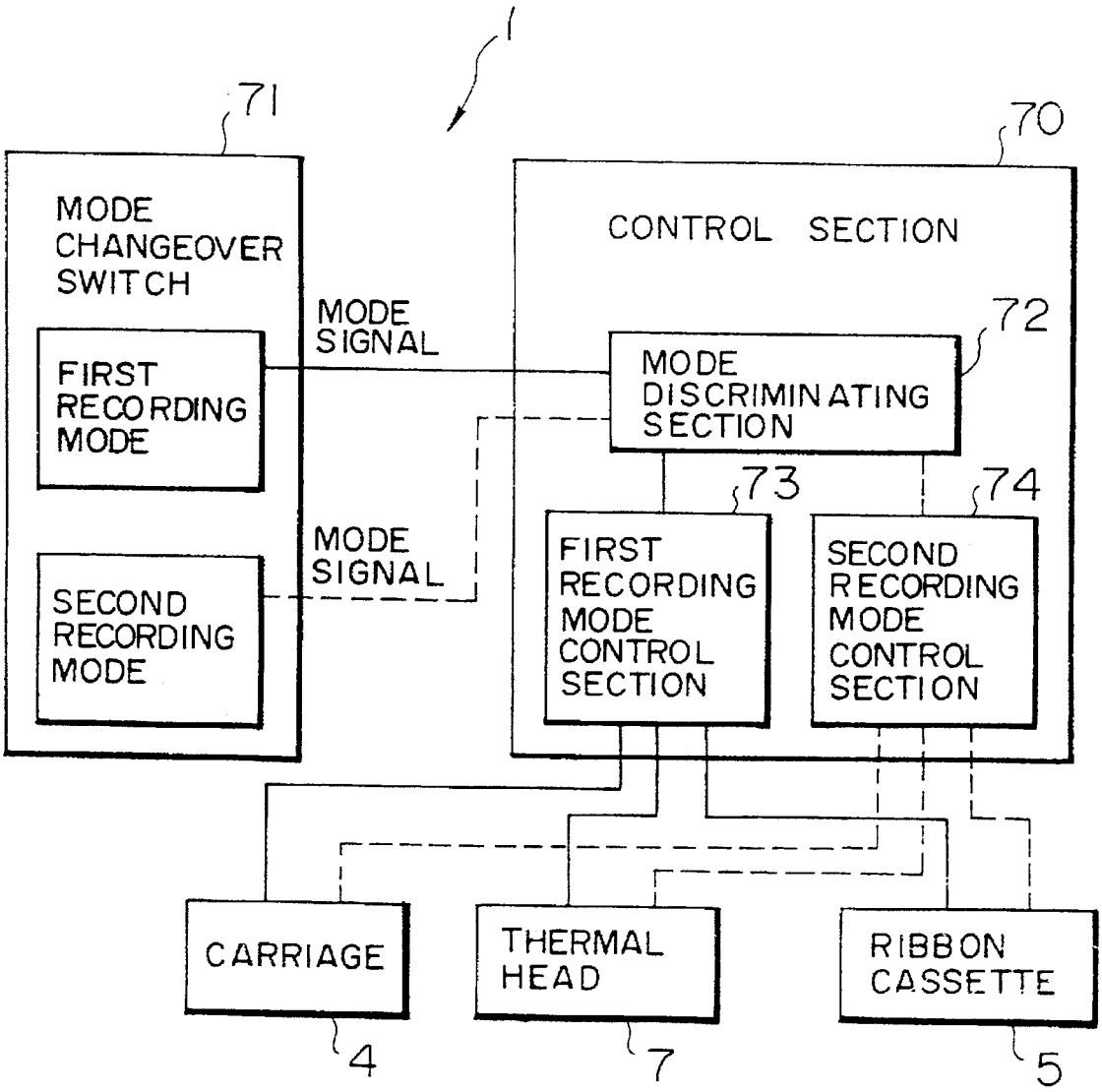
FIG. 11 is a block diagram showing the construction of the control system of the thermal transfer printer of this embodiment.

As shown in FIG. 11, the control section 70, which is composed of a memory, CPU, etc. (not shown), includes a mode discriminating section 72, a first recording mode control section 73 and a second recording mode control section 74. The mode discriminating section 72 makes a judgment, on the basis of a mode signal supplied from a mode changeover switch 71 arranged at a desired position in the frame (not shown), at least as to whether the apparatus is in a first recording mode in which recording by hot melt transfer is performed on printing paper, such as ordinary paper, by using the hot melt type ink ribbon 17*a* or a second recording mode in which recording by hot sublimation transfer is performed on a special kind of paper by using the hot sublimation type ink ribbon 17*b*. The first recording mode control section 73 and the second recording mode control section 74 control, on the basis of the judgment result of the mode discriminating section 72, the moving speed of the carriage 4, the energization period for the thermal head 7, the press contact force for the thermal head 7 with respect to the platen 2, the ribbon cassette 5, etc. in accordance with the mode. Further, the control section 70 discriminates or detects, on the basis of the output signal from the first optical sensor 18 due to the movement of the carriage 4, the presence of the ribbon cassette 5, the kind of ink ribbon 17 accommodated in the ribbon cassette 5, the displacement of the carriage 4 with respect to the home position, the opening/closing state of the canopy 19, the distance between the ribbon cassettes 5, etc. In addition, the control section 70 controls the driving of the carriage 4, etc. on the basis of an end detection signal regarding the ink ribbon 17 supplied from the second optical sensor 57.

Next, the operation of this embodiment, constructed as described above, will be explained.

The thermal transfer printer 1 of this embodiment is driven, and the operator manipulates the mode changeover switch 71 in accordance with the recording purpose, selecting either the first recording mode in which recording by hot melt transfer is performed on printing paper, such as ordinary paper, by using the hot melt type ink ribbon 17*a* or the second recording mode in which recording by hot sublimation transfer is performed on a special kind of paper by using the hot sublimation type ink ribbon 17*b*.

When the recording mode selecting operation has been executed, a mode signal corresponding to the selected mode is supplied from the mode changeover switch 71 to the control section 70. The mode discriminating section 72 of the control section 70 makes a judgment as to whether the mode signal from the mode changeover switch 71 indicates the first recording mode or the second recording mode. In accordance with the judgment result, it causes either the first recording mode control section 73 or the second recording mode control section 74 to operate, and the operation of selecting the ribbon cassette 5 accommodating the ink ribbon 17 corresponding to the first recording mode or the second recording mode is started.

Next, when the operation of selecting the ribbon cassette 5 has been started, the carriage 4, which is at the home position, is moved (caused to travel) in response to a command from the control section 70 (more specifically, from either the first recording mode control section 73 or the second recording mode control section 74), and the first optical sensor 18, which is arranged on the carriage 4, detects the identification mark 23 of the ribbon cassette 5. Then, the first optical sensor 18 supplies a detection signal, which varies with the arrangement, pitch, etc. of the non-reflecting sections 24*a* and is peculiar to each identification mark 23, to the control section 70, where a judgment is made as to whether it is the identification mark 23 corresponding to the command issued from the control section 70. When it is the identification mark 23 corresponding to the command, the movement of the carriage 4 is stopped. When it is not the identification mark 23 corresponding to the command, the movement of the carriage 4 is continued until the identification mark 23 corresponding to the command is detected. Thus, in this embodiment, the kind of ink ribbon 17 is detected on the basis of the difference in the reflective seal 24 of the ribbon cassette 5. In this way, it is possible to reliably discriminate the type of ribbon cassette 5 (in other words, the kind of ink ribbon 17).

Then, the ribbon cassette 5 accommodating the ink ribbon 17 corresponding to the selected recording mode is selectively passed over between the canopy 19 and the carriage 4*b*, as indicated by the arrows B of FIG. 2, by the parallel crank mechanism 8 and the rotary crank mechanism 11, and the ribbon casette 5 is attached to the carriage 4, with which the operation of selecting the ribbon cassette 5 is completed.

Then, when the operation of selecting the ribbon cassette 5 has been completed, printing paper corresponding to the selected recording mode is set between the platen 2 and the thermal head 7 manually or by a paper feeding device (not shown) and, at the same time, switching between the hot separation of the hot melt type ink ribbon 17*a* and the cold separation of the hot sublimation type ink ribbon 17*b* is effected.

First, as shown in FIG. 4, in the condition in which the cam 28 has rotated to the leftmost position as seen in the drawing, the pin 37 of the head press contact lever 36 is positioned in the outermost periphery of the head contact/separation cam groove 30, so that the head press contact lever 36 is caused to abut the stopper 35 of the head lever 33 by the biasing force of the strong press contact spring 39, and the head mounting base 34 is operated together with the press contact lever 36. Thus, by the swinging motion of the head press contact lever 36, the thermal head 7 is held in the head-up condition in which it is separated from the platen 2.

The swinging plate 44 is swung to the right and left by the ribbon take-up cam groove 31, the transmission gear 47 supported by the swinging plate 44 is in mesh with the take-up gear 51, and the carriage 4 moves along the platen 2, whereby the driving gear in mesh with the rack 40 is rotated, and then take-up gear 51 and the second take-up gear 52 are rotated through the transmission gears 47 and 48 to effect the operation of taking up the ink ribbon 17 by the rotation of the take-up bobbin 16*a* and the second take-up bobbin 49.

When the cam 28 is at this position, no recording is performed but a color sensing operation is conducted by the photo sensor 57 in the case in which a colored ink ribbon 17 is used, or a slack removing operation is executed when the ink ribbon 17 has slacked.

Figure 6:
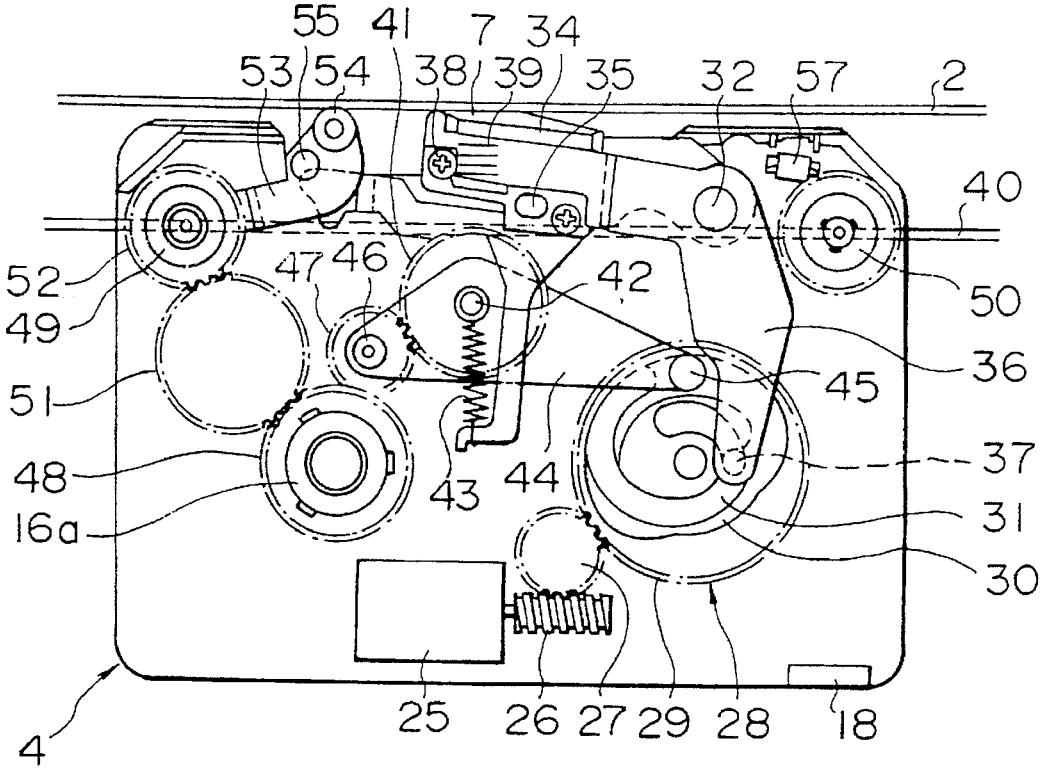
FIG. 6 is a schematic diagram showing the thermal transfer printer of this embodiment in a first recording state.
Figure 7:
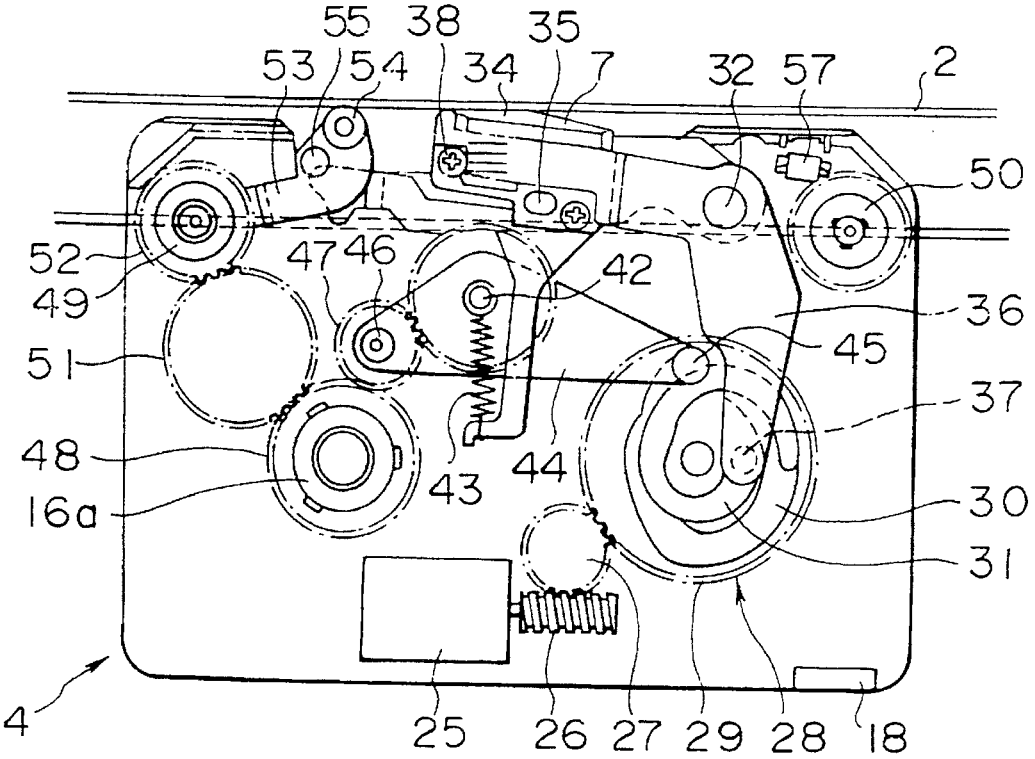
FIG. 7 is a schematic diagram showing the thermal transfer printer of this embodiment in a second recording state.

Then, as shown in FIG. 7, the motor 22 in the condition of FIG. 6 is driven to thereby rotate the cam 28 to the right. As a result, the head press lever 36 is not swung, but the swinging plate 44 is swung to the right by the ribbon take-up cam groove 31 while retaining the thermal head 7 in the head-up condition in which it is separated from the platen 2, the transmission gear 47 of the swinging plate 44 being separated from the take-up gear 51. In this condition, the rotation of the driving gear 41 is not transmitted to the take-up bobbin 16*a* and the second take-up bobbin 49 even when the carriage 4 moves, and the operation of taking up the ink ribbon 17 is not executed, so that the operation of returning the carriage 4 or the ribbon saving operation is conducted.

Figure 5:
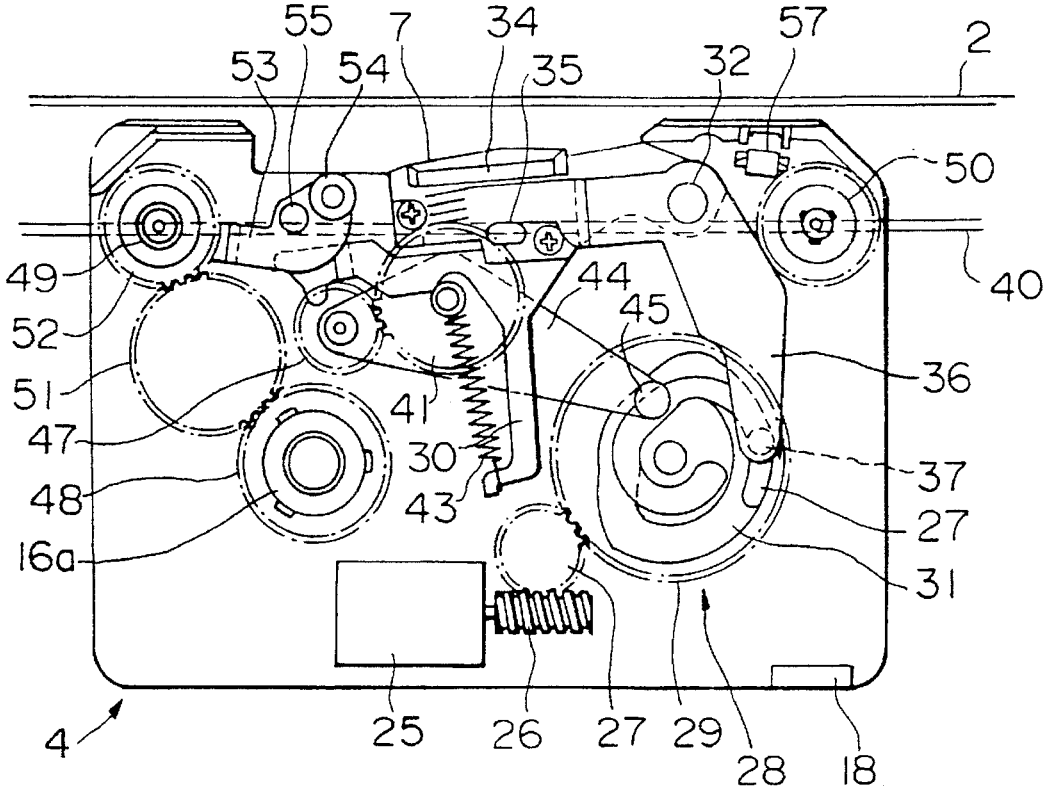
FIG. 5 is a schematic diagram showing the thermal transfer printer of this embodiment in carriage return operation.

When the ribbon cassette 5*a* accommodating the hot melt type ink ribbon 17 for hot separation is attached to the carriage 4 to perform printing on printing paper like ordinary paper, the motor 25 in the state as shown in FIG. 5 is further driven as shown in FIG. 6 to rotate the cam 28 to the right to thereby cause the head press contact lever 36 to swing to the right, whereby the head lever 33 is also swung through the strong press contact spring 39. In this condition, the pin 37 of the head press contact lever 36 is at a position closest to the center of rotation of the head contact/separation cam groove 30, so that the head press contact lever 36 is swung around the support shaft 32 to the rightmost position, whereby the head press contact lever 36 is separated from the stopper 35 of the head mounting base 34, which is pressed by the spring holding section 38 of the head press contact lever 36 through the intermediation of the strong press contact spring 39. In this condition, the biasing force of the weak press contact spring 43 is imparted to the head lever 33, so that a pressing force which is the biasing force of the strong press contact spring 39 plus the biasing force of the weak press contact spring 43 is imparted, whereby the thermal head 4 is pressed against the platen 2 with a strong pressing force.

At this time, the pressing/moving plate 57 is not formed in the ribbon cassette 5 containing the heat melt type ink ribbon 17*a* shown in FIG. 9, so that the engagement pin 55 of the carriage 5 is not pressed, and no engagement occurs between the engagement pin 55 and the head lever 33. Thus, even when the head lever 33 rotates, the separation lever 53 is not rotated, and the separation roller 54 is held at the same position.

Further, in this embodiment, the head lever 33, which brings the thermal head 7 into press contact with the platen 2, and the support shaft 32 which constitutes the center of rotation of the head press contact lever 36, are made so long as protrude from the upper surface of the carriage 4, so that fulcrum rattling of the head lever 33 and of the head press contact lever 36 can be prevented, whereby it is possible to support the head lever 33, etc. with high accuracy, making it possible for the press contact operation of the thermal head 7 to be conducted in a stable manner.

The swinging plate 44 is rotated to the left from the position as shown in FIG. 5, and the transmission gear 47 of the swinging plate 44 is again engaged with the take-up gear 51, the ribbon take-up operation being effected through the movement of the carriage 4.

In this condition, the carriage 4 is moved, whereby the driving gear 41 is rotated through the rack 40, and the take-up gear 51 and the second take-up gear 52 are rotated through the intermediation of the transmission gears 47 and 48 to rotate the take-up bobbin 16*a* and the second take-up bobbin 49 and to drive the thermal head 7 on the basis of a desired recording signal while taking up the ink ribbon 17 of the ribbon cassette 5, whereby recording is effected on a predetermined sheet of paper. At this time, the thermal head 7 is held in press contact with a great pressing force, so that a satisfactory recording can be performed.

When a recording with high image quality, which is different from the ordinary recording, is to be performed on a special kind of paper by attaching the ribbon cassette **5*b* containing the hot sublimation ink ribbon 17*b* requiring cold separation, the motor 25 in the condition as shown in FIG. 5 is driven to cause the cam 28 to rotate to the left past the position as shown in FIG. 6, whereby, as in the case of FIG. 6, the head press contact lever 36 is swung to the right together with the head lever 33. In this condition, the pin 37 of the head press contact lever 36 is in the innermost periphery of the head contact/separation cam groove 30, and the width of the head separation/contact cam groove 30 at this position is large, so that a gap is formed between the pin 37 of the head press contact lever 36 and the head contact/separation cam groove 30, whereby the head press contact lever 36 is rotated so as to abut the stopper 35 by the biasing force of the strong press contact spring 39, with the result that the thermal head 7 is pressed against the platen 2 with only the biasing force of the weak press contact spring 43**, thereby making it possible to perform recording with a press contact force weaker than that in the usual recording.

The ribbon cassette **5*b* containing the hot sublimation ink ribbon has the pressing/moving plate 61, by means of which the engagement pin 55 is pressed downwards to be engaged with the head lever 33, so that, when the head lever 33 is swung, the separation lever 53 is rotated through the engagement pin 55, and the separation roller 54 is pressed against the platen 2, thereby making it possible to increase the length of separation between the ink ribbon 17** and the paper after recording.

Even when the cam 28 is rotated, the transmission gear 47 of the swinging plate 44 is held in mesh with the take-up gear 51, so that, as in the case of the hot separation, the ink ribbon **17*b* can be taken up through the movement of the carriage 4**.

In this way, by selecting the position of the cam 28 as required by the situation, the thermal printer can perform a variety of operations.

In the above description, the position of the cam 28 is successively selected from the condition as shown in FIG. 4 to that shown in FIG. 7. To change from the condition shown in FIG. 7 to that shown in FIG. 4, the cam 28 is driven in a direction reverse to that in the above description.

Next, in the case of the first recording mode, when the recording operation is actually started, control is effected in accordance with the command from the control section 70 (more specifically, the first recording mode control section 73) such that the press contact force with which the thermal head 7 is pressed against the platen 2 in the head down condition is approximately 0.5 to 3.0 kg; that the moving speed (the recording speed) of the carriage 4 (the thermal head 7) is approximately 10 to 50 cm/sec.; and that the energization time per dot for the thermal head 7 (more specifically, the heat generating elements) is approximately 50 to 2000 μsec., whereby recording by hot melt transfer can be reliably performed on printing paper, such as ordinary paper, by using the hot melt type in ribbon **17*a***.

In the case of the second recording mode, control is effected in accordance with the command from the control section 70 (more specifically, the second recording mode control section 74) such that the press contact force with which the thermal head 7 is pressed against the platen 2 in the head down condition is approximately 0.2 to 1.5 kg; that the moving speed (the recording speed) of the carriage 4 (the thermal head 7) is approximately 0.2 to 25 cm/sec.; and that the energization time per dot for the thermal head 7 (more specifically, the heat generating elements) is approximately 150 to 3000 μsec., whereby recording by hot sublimation transfer can be reliably performed on a special kind of surface-treated printing paper by using the hot sublimation type ink ribbon **17*b***.

Further, by making the press contact force with which the thermal head 7 is pressed against the platen 2 in the second recording mode, in which the hot sublimation type ink ribbon **17*b* is used, is made weaker than the press contact force with which the thermal head 7 is pressed against the platen 2 in the first recording mode, in which the hot melt type in ribbon 17*a* is used, the wear of the thermal head 7 is reduced in the second recording mode, in which the energy imparted to the thermal head 7 is larger than that in the first recording mode, thereby making it possible to positively improve the general durability of the thermal head 7**.

Further, by making the moving speed (recording speed) of the carriage 4 (the thermal head 7) in the second recording mode lower than that in the first recording mode, and by making the energization time per dot for the thermal head 7 (more specifically, the heat generating elements) in the second recording mode longer than that in the first recording mode or repeating the energization a plurality of times, it is possible to reliably perform printing in the second recording mode, in which transfer to the printing paper is effected by sublimating the hot sublimation ink and which requires a greater amount of energy than the printing in the first recording mode, in which transfer to the printing paper is effected by melting the hot melt ink. Thus, it is possible to obtain a high image quality in recording which is comparable to that of silver salt photographs.

Further, it is to be noted that, by repeating the energization per dot for the thermal head 7 (more specifically, the heat generating elements) in the second recording mode a plurality of times, it is possible to reliably prevent the danger of damages that might be caused if the energization time were simply increased to such a degree as to cause the permissible temperature in heat generation for the heat generating elements of the thermal head 7 to be exceeded.

Further, in the thermal transfer printer 1 of this embodiment, the mode changeover switch 71 is switched over in accordance with the recording purpose, whereby it is possible to easily select between the first recording mode, in which recording is performed on a variety of printing paper by using the hot melt ink ribbon **17*a*, and the second recording mode, in which a recording with high image quality comparable to that of silver salt photographs is performed on a special kind of printing paper by using the hot sublimation ink ribbon, so that it is possible to reliably perform both ordinary recording on paper and high image quality recording comparable to silver salt photographs with a single thermal transfer printer 1** and, at the same time, a positive reduction in installation space as compared to the prior art can be achieved.

Further, in this embodiment, the press/moving plate 61 formed on the ribbon cassette 5 presses the engagement pin 55 of the separation lever 53 to cause the engagement pin 55 to be engaged with the head lever 33, so that the rotation of the head lever 33 causes the separation lever 53 to operate to effect the contact/separation operation for the separation roller 54 with respect to the platen 2, whereby there is no need to provide a separate driving device for operating the separation lever 53, and the control of the driving device can be easily effected. Further, there is no need to secure a large installation space in the carriage 5, and a reduction in the size of the apparatus as a whole can be achieved. Moreover, a reduction in parts cost can be achieved for inexpensive production.

Furthermore, since the press/moving plate 57 for pressing the engagement pin 55 is formed only on that ribbon cassette in which the ink ribbon 17 for cold separation is accommodated, so that the separation lever 53 can only be selectively operated when the ribbon cassette 5 containing the ink ribbon 17 for cold separation is attached.

It should be noted that the present invention is not restricted to the above-described embodiment but allows various modifications as needed. For example, while in the above-described embodiment an ink ribbon is used as the ink film, this should not be construed restrictively. Other kinds of ink film are also applicable as long as they can be accommodated in the cassette.

As described above, the thermal transfer printer of the present invention is very advantageous in that it makes it possible to reliably perform, with a single printer, both the recording using an ink film coated with a hot melt ink and the recording using an ink film coated with a hot sublimation ink.

What is claimed is:

1. A thermal transfer printer comprising:

a frame;

a platen fixedly mounted to the frame;

a carriage movably mounted on the frame adjacent the platen;

carriage movement means connected to the carriage for selectively moving the carriage along the platen;

a thermal head movably mounted on the carriage, the thermal head including a plurality of heat generating elements;

a cassette holding section mounted adjacent the platen for detachably holding first and second ribbon cassettes, each of the first and second ribbon cassettes housing an ink ribbon;

cassette delivering means for delivering one of the first ribbon cassette and the second ribbon cassette from the cassette holding section onto the carriage such that the ink ribbon is located between the thermal head and the platen; and a control section for selectively controlling the carriage movement means and the cassette delivering means in response to first and second mode signals;

wherein when the control section receives the first mode signal, the control section controls the cassette delivery means to mount the first cassette onto the carriage, and to control the carriage movement means such that the carriage moves at a first speed along the platen;

wherein when the control section receives the second mode signal, the control section controls the cassette delivery means to mount the second cassette onto the carriage, and to control the carriage movement means such that the carriage moves at a second speed along the platen; and wherein the first speed differs from the second speed.

2. The thermal transfer printer according to claim 1, further comprising head movement means connected to the thermal head for selectively moving the thermal head toward the platen;

wherein the control section selectively controls the heating elements of the thermal head and the head movement means in response to the first and second mode signals such that, when the control section receives the first mode signal, the control section controls the head movement means to move the thermal head toward the platen such that the thermal head applies a first pressure against the ink ribbon of the first ribbon cassette, and applies current to selected ones of the heat generating elements of the thermal head for a first period of time, and when the control section receives the second mode signal, the control section controls the head movement means to move the thermal head toward the platen such that the thermal head applies a second pressure against the ink ribbon of the second ribbon cassette, and applies current to selected ones of the heat generating elements of the thermal head for a second period of time; and wherein the first pressure differs from the second pressure, and the first period of time differs from the second period of time.

3. The thermal transfer printer according to claim 1, further comprising a sensor mounted on the carriage for discriminating between the first ribbon cassette and the second ribbon cassette by sensing an identification mark formed on each of the first cassette and the second ribbon cassette.

4. The thermal transfer printer according to claim 1, further comprising a roller movably mounted on the carriage and roller moving means for selectively moving the roller toward the platen;

wherein the control section controls the roller moving means to move the roller toward the platen to press a portion of the ink ribbon of the first ribbon cassette against the platen in response to the first mode signal, and to position the roller away from the platen in response to the second mode signal.

5. A thermal transfer printer comprising:

a frame;

a platen fixedly mounted to the frame;

a carriage movably mounted on the frame adjacent the platen;

a thermal head movably mounted on the carriage, the thermal head including a plurality of heat generating elements;

a cassette holding section mounted adjacent the platen for detachably holding a first and second ribbon cassettes, the first ribbon cassette housing a hot melt type ink ribbon and the second ribbon cassette housing a hot sublimation type ink ribbon;

cassette delivering means for delivering one of the first ribbon cassette and the second ribbon cassette from the cassette holding section onto the carriage such that the ink ribbon is located between the thermal head and the platen; and a control section for selectively controlling the cassette delivering means and for applying current to the plurality of heat generating elements of the thermal head in response to one of a first and second mode signals;

wherein when the control section receives the first mode signal, the control section controls the cassette delivery means to mount the first cassette onto the carriage, and to apply current to selected ones of the heat generating elements for a first period of time;

wherein when the control section receives the second mode signal, the control section controls the cassette delivery means to mount the second cassette onto the carriage, and to apply current to selected ones of the heat generating elements for a second period of time; and wherein the first period of time differs from the second period of time.

6. The thermal transfer printer according to claim 5, further comprising head movement means connected to the thermal head for selectively moving the thermal head toward the platen;

wherein the control section selectively controls the head movement means in response to the first and second mode signals such that, when the control section receives the first mode signal, the control section controls the head movement means to move the thermal head toward the platen such that the thermal head applies a first pressure against the ink ribbon of the first ribbon cassette, and when the control section receives the second mode signal, the control section controls the head movement means to move the thermal head toward the platen such that the thermal head applies a second pressure against the ink ribbon of the second ribbon cassette; and wherein the first pressure differs from the second pressure.

7. The thermal transfer printer according to claim 5, further comprising a sensor mounted on the carriage for discriminating between the first ribbon cassette and the second ribbon cassette by sensing an identification mark formed on each of the first cassette and the second ribbon cassette.

8. The thermal transfer printer according to claim 5, further comprising a roller movably mounted on the carriage and roller moving means for selectively moving the roller toward the platen;

wherein the control section controls the roller moving means to move the roller toward the platen to press a portion of the ink ribbon of the first ribbon cassette against the platen in response to the first mode signal, and to position the roller away from the platen in response to the second mode signal.

* * * * *